US005162703A

United States Patent [19]

Schmees et al.

[11] Patent Number: 5,162,703

[45] Date of Patent: Nov. 10, 1992

[54] FLASHING LIGHT WARNING APPARATUS

[75] Inventors: Siegfried Schmees, Geseke; Werner Kohl; Wolfgang Grimm, both of Bremen; Heiko Janssen, Delmenhorst, all of Fed. Rep. of Germany

[73] Assignee: Hella KG Hueck & Company, Lippstadt, Fed. Rep. of Germany

[21] Appl. No.: 696,965

[22] Filed: May 8, 1991

[30] Foreign Application Priority Data

May 14, 1990 [DE] Fed. Rep. of Germany ..... 4015402

[51] Int. Cl.[5] ..... H05B 37/00

[52] U.S. Cl. ..... 315/241 R; 315/244; 315/219; 315/223; 315/239

[58] Field of Search ..... 315/247, 244, 219, 223, 315/239, DIG. 7, 241

[56] References Cited

U.S. PATENT DOCUMENTS

| | | | |
|---|---|---|---|
| 3,644,818 | 2/1972 | Paget | 321/18 |
| 4,410,837 | 10/1983 | Suzuki et al. | 315/241 R |
| 4,477,796 | 10/1984 | Kearsley | 315/200 A |
| 4,748,382 | 5/1988 | Walker | 315/241 P |

FOREIGN PATENT DOCUMENTS 2906919 8/1979 Fed. Rep. of Germany .

*Primary Examiner*—Eugene R. LaRoche
*Assistant Examiner*—R. A. Ratliff
*Attorney, Agent, or Firm*—Griffin, Butler, Whisenhunt & Kurtossy

[57] ABSTRACT

A flashing light warning apparatus, which includes a voltage source (U), a main gate transformer (HW), a flash tube (R), an ignition device (Z), at least one storage condenser (K), and an electrical switching device (S), can be switched to provide light energy for daytime flashes and nighttime flashes in an uncomplicated, cost effective system which produces dependable light flashes. The night flashes have a light energy such that they can be seen from afar only with night vision apparatus. When the switching device turns off voltage production of the main gate transformer or further transmission of voltage from the at least one storage condenser, the ignition device is coupled to an auxiliary gate transformer (ZW) for carrying out light flash production by means of high frequency ignition voltage produced by the ignition device.

7 Claims, 2 Drawing Sheets

FLASHING LIGHT WARNING APPARATUS

BACKGROUND OF THE INVENTION

This invention relates to a flashing light warning apparatus of a type having a voltage source, a main gate (or isolation, or barrier) transformer, a flash tube, an ignition device, at least one storage condenser, and an electrical switching device.

A flashing light warning apparatus of a type including a voltage source, a main gate transformer, a flash tube, an ignition device, at least one storage condenser, and an electrical switching device is well known from U.S. Pat. No. 3,644,818 to Paget. The flashing light warning apparatus of that patent includes two storage condensers, one of which is arranged in series with an electrical switching device. When the electrical charged with the same charging voltage from the main gate transformer. When the electrical switching device is open, the first storage condenser is charged somewhat more slowly than the second storage condenser via a resistor. By this means, electrical energy fed to the flash tube, and thereby light flash energy is influenced dependent upon the condition of the electrical switching device such that the light flash energy is reduced when the switching device is open.

This known light flash warning device has, however, a disadvantage in that light flash energies less than 50 mWs (milliwatt-seconds, or milli-joules are not achievable because the first storage condenser as well as the second storage condenser, upon operation of the light flash warning apparatus will be continuously charged and then discharged through the flash tube. The resistor which causes a slower charging of the first condenser, results only in a somewhat reduced charge on the first storage condenser when the gate transformer is turned off after a predetermined time period, such as, for example, once the second storage condenser is charged, thereby requiring an expensive, or difficult, control of the gate transformer. However, even then, if the first storage condenser is charged and discharged over the flash tube, a light energy is emitted from the flash tube which greatly disturbs and sometimes makes unuseful flight operations involving use of night vision apparatus, otherwise known as night-vision goggles (NVG).

Thus, a purpose of this invention is to provide a flashing light warning apparatus which is uncomplicated and can be cost-effectively produced and which while producing dependable light flashes allows a switching of a light energy level between nighttime and daytime flashes so that a night flash has a light energy level which can be viewed from afar only with night vision apparatus.

SUMMARY OF THE INVENTION

According to principles of this invention, the switching device can turn off voltage production of a main gate transformer or further transmission of voltage from at least one storage condenser, an ignition device is coupled to an auxiliary transformer and light flashes are produced by means of high frequency ignition voltage produced by the ignition device when voltage of the main gate transformer is turned off or when further transmission (or further application) of voltage from the at least one storage condenser is turned off.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
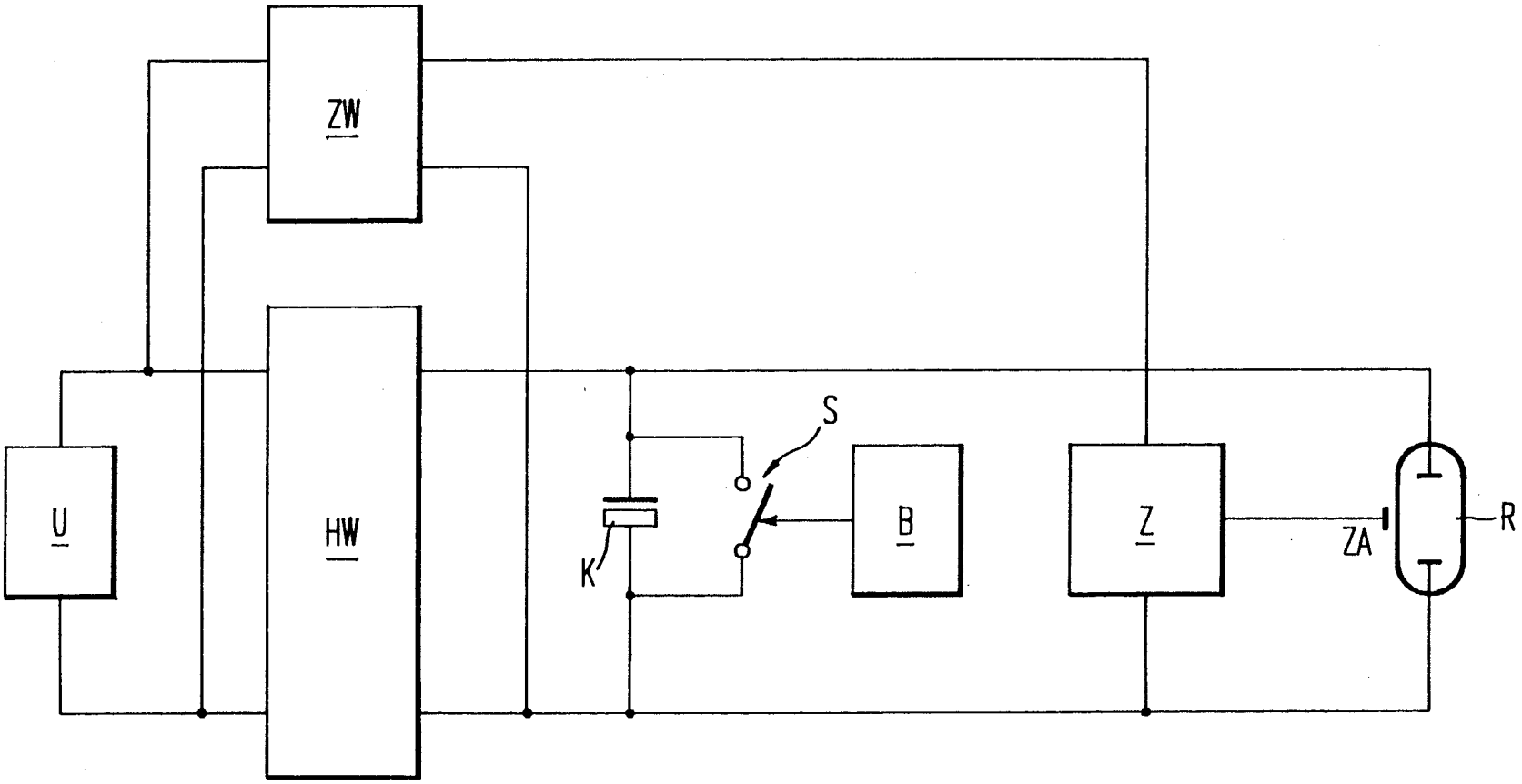
FIG. 1 is a partially block, partially schematic, diagram of a flashing light warning apparatus of this invention.

FIG. 1 is basically a block diagram of an embodiment of the flashing light warning apparatus of this invention. A main gate transformer HW is electrically connected with a voltage source U, which can be a direct, or non-changing, voltage source or an alternating, or changing, voltage source. The main gate transformer HW converts the voltage of the voltage source U into a direct voltage which is necessary to charge a storage condenser K connected in parallel across outputs of the main gate transformer HW to a charge voltage sufficient to make available to a flash tube R, connected in parallel to the storage condenser K, a sufficient light energy for daytime operation upon ignition thereof.

A switching device S is arranged in parallel to the storage condenser K, which is switchable by a control device B. The switching device S can be a transistor, thyristor, or a similar switching element. Switching by the control device can take place upon manual operation of the control device B, however, it can also take place automatically dependent upon predetermined parameters, for example, an automatic switching can be brought about upon nighttime operation.

Because when the switching device S is closed, the short-circuit rated (designed to operate under short circuited conditions) main gate transformer HW is short circuited and cannot provide the ignition device Z, which is for producing high frequency ignition signals, with voltage, the ignition device Z is here, for example, connected via an auxiliary gate transformer ZW to the voltage source U. The auxiliary gate transformer ZW the voltage source U, which voltage is made available to the ignition device Z for production of high frequency ignition voltage. The auxiliary gate transformer ZW can be a particularly uncomplicated and cost effective element. In another embodiment the auxiliary gate transformer ZW, also in a particular uncomplicated and cost effective arrangement, can be part of the main gate transformer HW.

The ignition device Z is here, for example, depicted as being a parallel ignition device. The ignition device Z, for the production of periodic ignition signals, can include a cyclical, or pulse, generator or can be controlled by a cyclical or pulse generator. The ignition signals are here, for example, fed from the ignition device Z to the ignition anode ZA of the light flash tube R. In another embodiment the ignition device Z can be constructed as a series ignition device in which the ignition signals to the light flash tube R are fed to a cathode of the light flash tube R.

In another embodiment, the control device B can operate on a switching device which controls operation of the main gate transformer HW such that the main gate transformer HW does not provide a voltage at its output to sufficiently charge the storage condenser K to a loaded voltage.

Operation of the flashing light warning apparatus of FIG. 1 will now be more particularly described by use of an example.

Upon day operation, the switching device S is controlled by the control device B to open the switch path of the switching device S. When the flashing light warning apparatus is in operation, the storage condenser K is charged. Corresponding to periodic high frequency ignition signals produced by the ignition device Z, energy stored in the storage condenser will be periodically transformed into high energy light flashes by discharge through the storage condenser K. The stored energy of the storage condenser K can, for example, be at around 100 Ws watt-seconds. In this regard, the stored energy is dependent upon respective requirements. For night operation, involving use of night vision apparatus, also known as night-vision goggles (NVG), the switching path of the switching device will be closed under control of the control device B so that the storage condenser K is short circuited, no stored energy can be charged in the storage condenser K and no stored energy can be given up by the storage condenser to the light flash tube R.

With a closed switching path of the switching device S, the light flash tube R is controlled alone from an ignition signal produced by the ignition device Z. These high frequency periodic high voltage signals from the ignition device Z produce in the light flash tube R a short lived, or short time, ionization so that with each ignition signal from the ignition device Z an ionization flash of reduced light energy is produced. The light energy is here., for example, smaller than 50 mWs milliwatt-seconds, or mill-joules. Light flash energy can thereby be reached in a range of around, for example, 10 mWs milliwatt-seconds, or milli-joules.

Upon creation of such smaller light flash energy, for one thing operation of airplanes or other transportation means using night vision devices is not disturbed by excessive-energy light flashes and for another thing it is assured that this mode of transportation remains recognizable upon employment of night vision apparatus.

Figure 3:
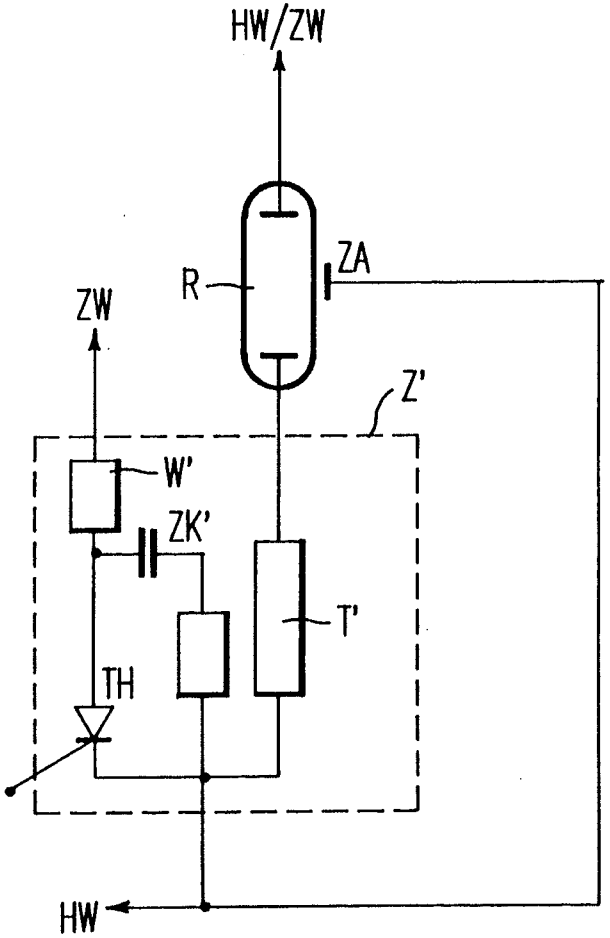
FIG. 3 is a second, series connected, embodiment of an ignition device for use in a flashing light warning apparatus similar to that depicted in FIG. 1.
Figure 2:
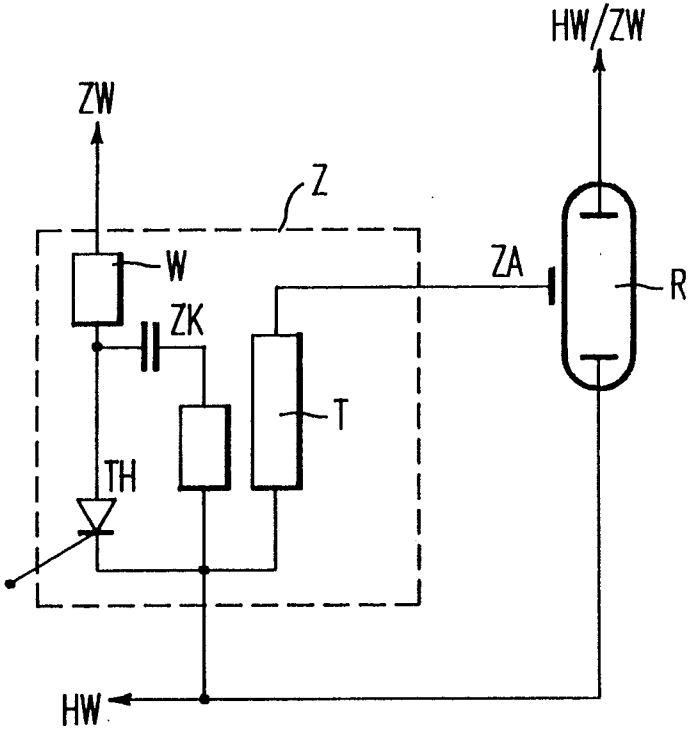
FIG. 2 is a schematic diagram of a first, parallel-connected, embodiment of an ignition device of the flashing light warning apparatus of FIG. 1.

FIG. 2 shows an example of an ignition device Z, which is a parallel ignition device Z. In FIG. 3 an example of an ignition device Z' is shown which is a series ignition device Z'. Both ignition devices are similarly constructed in that each respectively includes a resistor W and W' and an ignition condenser ZK and ZK' which is coupled to a transformer T and T' whereby ignition energy of the ignition condenser ZK and ZK' can be switched to a primary winding of the transformer T and T' by a switch TH which here, for example, is a thyristor which is controlled by a cyclical generator (not shown) so that a secondary winding thereof provides an ignition signal to the light flash tube R.

In the parallel ignition device Z of FIG. 2, a secondary winding of the transformer T is coupled with an ignition anode ZA of the light flash tube R. In the series ignition device Z' of FIG. 3, the secondary winding of the transformer T' is coupled to a cathode of coupled with a negative voltage terminal of the main gate transformer HW. In each of the switching arrangements, the ignition device Z and Z' is provided with voltage from the auxiliary gate transformer ZW.

It is beneficial that the switching device can turn off voltage production of the main gate transformer or further transmission of voltage from the at least one storage condenser because this prevents in a particularly uncomplicated and cost effective manner, that the storage condenser can be charged and can provide a stored energy to the flash tube during night operation when night vision apparatus are used.

Because, the ignition device is coupled to an auxiliary gate transformer and because light flash production results from high frequency ignition voltage produced by the ignition device when voltage from the main gate transformer or further voltage transmission of the at least one storage condenser is turned off, a first benefit is derived in that production of the high frequency ignition voltage by the ignition device is independent of voltage supplied by the main gate transformer and a second benefit is derived in that the high frequency ignition voltage can produce light flashes which come about only by ionization in the light flash tube caused by the high frequency high voltage stimulation and which have a light flash energy less than 50 mWs milliwatt-seconds, or milli-joules, which during night flight operation, when night vision apparatus are used, do not create disturbances which, for example, can cause blinding of a pilot.

It is beneficial that the switching path of the switching device is arranged parallel to the storage condenser because in this manner, in a particularly uncomplicated and cost effective manner, further transmission of the stored energy of the storage condenser can be avoided when the switching device is closed. Because when the switching device is closed a short circuit is produced, it is beneficial for the main gate transformer to be designed for short circuited operation.

By making the switching device a part of the main gate transformer, the benefit arises that a particularly uncomplicated and cost effective influencing of production of voltage by the main gate transformer can take place.

It is a benefit that the switching device is switchable, or controllable, by a control device because in this manner a particularly dependable switching between daytime operation and nighttime operation is brought about for one thing and for another thing a manual as well as an automatic switching is made possible.

It is beneficial that the ignition device can be either a parallel or a series ignition device because in this manner, depending upon an application thereof, a particularly reliable and dependable ignition of the flash tube for daytime operation as well as nighttime operation is made possible.

Because the ignition device includes a cyclical, or pulse generator, or is coupled to a cyclical or pulse generator, a benefit results that a particularly reliable and dependable ignition of the flash tube in regular or changeable time periods is made possible.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed or defined as follows:

1. In a flashing light warning apparatus having a voltage source, a main transformer, a flash tube, an ignition device, at least one storage condenser, and an electrical switching device;

the improvement wherein the switching device can turn off voltage of the main transformer or voltage further transmitted by the at least one storage condenser, wherein is further included an auxiliary transformer coupled to the ignition device, and wherein, when voltage of the main transformer or voltage further transmitted by the at least one storage condenser is turned off, light flashes result from high frequency ignition voltage produced by the ignition device.

2. In a flashing light warning apparatus as in claim 1 wherein a switching path of the switching device is arranged in parallel with the storage condenser.

3. In a flashing light warning apparatus as in claim 1 wherein the switching device is part of the main transformer.

4. In a flashing light warning apparatus as in claim 2 wherein the switching device is switched by a control device.

5. In a flashing light warning apparatus as in claim 4 wherein the ignition device is a parallel or a series ignition device.

6. In a flashing light warning apparatus as in claim 5 wherein the ignition device includes or is coupled to a cyclical generator.

7. In a flashing light warning apparatus as in claim 1 wherein when voltage of the main transformer and voltage further transmitted by the at least one storage condenser is substantially turned off, light flashes result from high frequency ignition voltage produced by the ignition device which is energized by the auxiliary transformer.

* * * * *